US007896158B2

(12) United States Patent
Taylor

(10) Patent No.: US 7,896,158 B2
(45) Date of Patent: Mar. 1, 2011

(54) TOOL BIT HOLDER

(75) Inventor: Curtis Taylor, Chagrin Falls, OH (US)

(73) Assignee: Curtis Taylor, Chagrin Falls, OH (US)

( * ) Notice: Subject to any disclaimer, the term of this patent is extended or adjusted under 35 U.S.C. 154(b) by 0 days.

(21) Appl. No.: 12/235,665

(22) Filed: Sep. 23, 2008

(65) Prior Publication Data

US 2010/0072094 A1 Mar. 25, 2010

(51) Int. Cl.
*B65D 85/28* (2006.01)

(52) U.S. Cl. ..... 206/377; 206/379; 206/372; 211/69; 408/239 R

(58) Field of Classification Search ..... 206/375, 206/379, 378, 377, 372, 373; 408/207, 239 R; 211/69, 70.6
See application file for complete search history.

(56) References Cited

U.S. PATENT DOCUMENTS 4,711,353 A * 12/1987 Rozmestor ..... 206/378
4,811,843 A * 3/1989 Stribiak ..... 206/349
5,525,314 A * 6/1996 Hurson ..... 422/300
5,681,539 A * 10/1997 Riley ..... 422/300
5,855,284 A * 1/1999 Dembicks ..... 211/70.6
6,092,655 A * 7/2000 Ernst ..... 206/378
6,217,332 B1 * 4/2001 Kumar ..... 433/173
6,405,864 B1 * 6/2002 Streich et al. ..... 206/373
6,474,481 B1 * 11/2002 Liu ..... 211/69
2003/0130101 A1 * 7/2003 Hwang ..... 483/59
2005/0241974 A1 * 11/2005 Chen ..... 206/379

* cited by examiner

*Primary Examiner*—David T Fidei
(74) *Attorney, Agent, or Firm*—Fay Sharpe LLP; Brian E. Turung

(57) ABSTRACT

A tool bit holder for releasably supporting a plurality of tool bits in a supported position wherein each tool bit has an elongated bit body extending from a working end to a tool end. The tool end of the bit being shaped to be received by a tool and the working end being shaped to engage an object such as a fastener. The bit further including an elongated side wall extending between the working and tool ends. The holder includes a frame having a plurality of spaced bit receiving nests and each of these nests has a bit opening shaped to receive one tool bit. The nests further including a flexible member movable relative to the tool bit opening and movable between an engaged position and a disengaged position such that the nest engages the elongated wall of the tool bit when the flexible member is in the engaged position and the associated bit is in the supported position thereby preventing relative movement between the nest and the associated bit. Further, the nest allows the tool bit to move relative to the opening when in the disengaged position.

33 Claims, 21 Drawing Sheets

TOOL BIT HOLDER

BACKGROUND

This application relates to the field of tool bits and more particularly, to a tool bit holder utilized to securely store one or more tool bits for future use. The invention of this application has been found to work particularly well with screw driver type tool bits and will therefore be discussed with particular reference to these styles of bits. However, it is to be understood that this application has broader application and can be used in connection with a wide range of tool bits.

Tool bits are well known and have been used for many years for a wide range of applications. In particular, tool bits formed from an octagonal bar stock have been used for years to form a wide range of tool bits including, but not limited to, Phillips drive bits, flat bits, and other bit configurations used to drive fasteners of all styles. These tool bits predominantly come in two lengths wherein the long style drill bits are attached directly to a driver or a power driver and the short style drill bits are used in connection with a drill bit holder which is then used in the manual or powered driver. As is known in the art, special application drill bits are available which can be several inches long for use in connection with fasteners that are difficult to reach. In today's market, the vast majority of the tool bits produced for screwdriver type applications are the short style drill bits that are less than one inch in length.

In view of the extreme popularity in these style of drill bits, they are widely used and include working ends that can be used for virtually any type of fastener. Accordingly, there are many different configurations of drill bits that an end user would have in his or her toolbox. Further, these tool bits have a limited life span and eventually will need to be replaced. As can be appreciated, a user of these styles of tool bits could have several dozen of these tool bits that must be organized so that they can be easily found when needed. Maintaining differently configured tool bits in a random pouch style packaging is inefficient and leads to significant frustration when a particular tool bit is desired.

Over the years, tool bit holders have been designed to help overcome these problems. However, these holders are difficult to use and inefficient in their application. Many of these prior art tool bit holders used technology relating to other types of tools which do not work particularly well in connection with octagonal tool bits and other small sized tool bits. As can be appreciated, the small octagonal tool bits do not include a significant amount of surface area for gripping with one's fingers wherein it is difficult to remove a tool bit from a bit holder that utilizes high frictional loads. While these high frictional loads adequately prevent the tool bit from inadvertently falling from the holder, they make it difficult for the user to remove the bit from the holder. This is particularly true for users that have reduced hand strength such as elderly users or young users. Overcoming this condition with reducing the frictional engagement by the tool holder has had negative consequences in that the tool bit can easily fall from the holder which prevents the usefulness of the device.

STATEMENT OF INVENTION

In accordance with the present invention, a tool bit holder for releasably supporting a plurality of tool bits in a supported position is provided wherein this tool bit allows for the easy removal of a tool bit while allowing the tool bit to be stored in a supportive position during non-use.

In this respect, in one embodiment, provided is a tool bit holder for releasably supporting a plurality of tool bits in a supported position wherein each tool bit has an elongated bit body extending from a working end to a tool end. The tool end of the bit being shaped to be received by a tool and the working end being shaped to engage an object such as a fastener. The bit further including an elongated side wall extending between the working and tool ends. The holder includes a frame having a plurality of spaced bit receiving nests and each of these nests has a bit opening shaped to receive one tool bit. The nests further including a flexible member movable relative to the tool bit opening and movable between an engaged position and a disengaged position such that the nest engages the elongated wall of the tool bit when the flexible member is in the engaged position and the associated bit is in the supported position thereby preventing relative movement between the nest and the associated bit. Further, the nest allows the tool bit to move relative to the opening when in the disengaged position.

In another embodiment, the opening is formed by a pliable grommet in the nest and the grommet includes an inwardly facing grommet surface defining the opening. In this embodiment, the grommet surface is adjacent to the elongated side wall of the tool bit when the bit is in the supported position. The flexible member deforms the grommet surface when in the engaged position such that the grommet surface frictionally engages the elongated surface thereby preventing relative movement.

In a further embodiment, the grommet frictionally engages the tool bit when in the engaged position and in the disengaged position; however, the frictional engagement in the engaged position is greater than the frictional engagement in the disengaged position such that relative movement of tool bit is at least partially restricted even when in the disengaged position.

In yet another embodiment, the tool bit holder includes a first and a second flexible member extending toward one another and which have an overlapping region wherein the overlapping region of the first and second members slideably engage one another and the bit opening is positioned in the overlapping region.

In yet a further embodiment, the tool bit holder includes a bit opening in each of the nest that is sized to allow unrestricted axial movement of the tool bit in the nest. The holder further includes two flexible members each having a frictional surface facing one another to be engageable with the tool bit when in the engaged position and being spaced from the tool bit when in the disengaged position.

BRIEF DESCRIPTION OF THE DRAWINGS

The foregoing, and more, will in part be obvious and in part be pointed out more fully hereinafter in conjunction with a written description of preferred embodiments of the present invention illustrated in the accompanying drawings in which.

DESCRIPTION OF PREFERRED EMBODIMENTS

Figure 1:
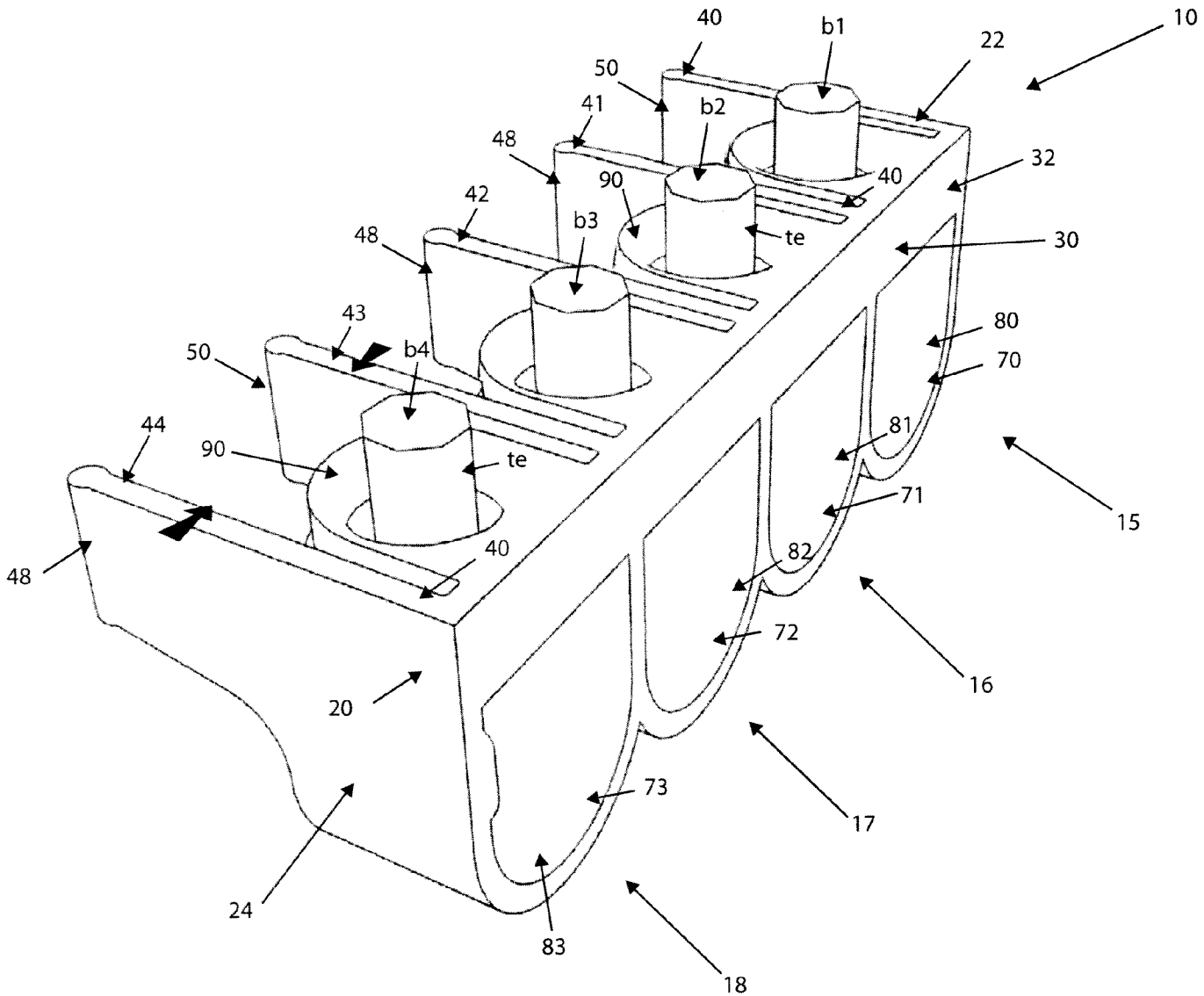
FIG. 1 is a rear side top perspective view of a tool bit holder according to one aspect of the present invention.
Figure 2:
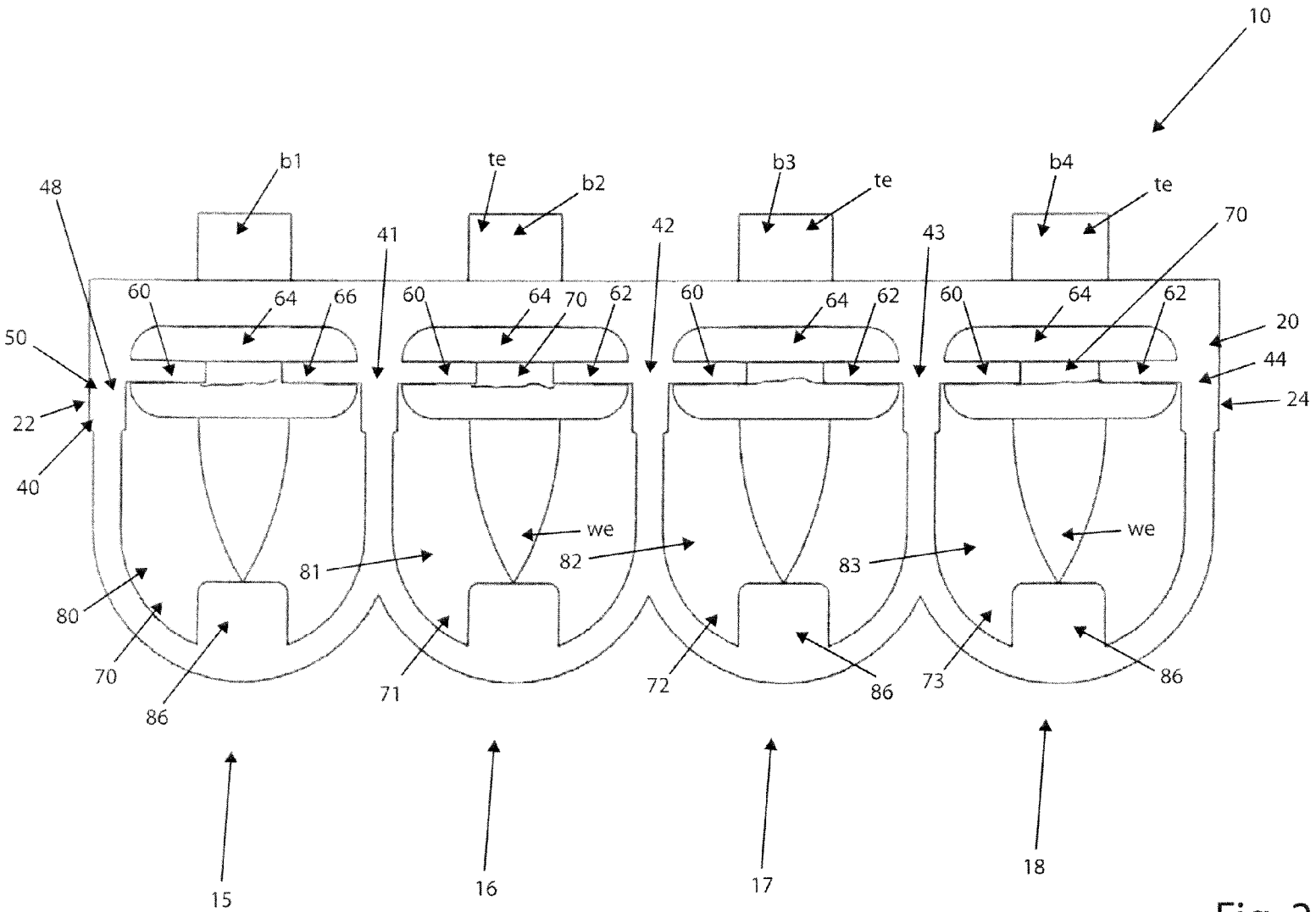
FIG. 2 is a front side view of the tool bit holder shown in FIG. 1.
Figure 3:
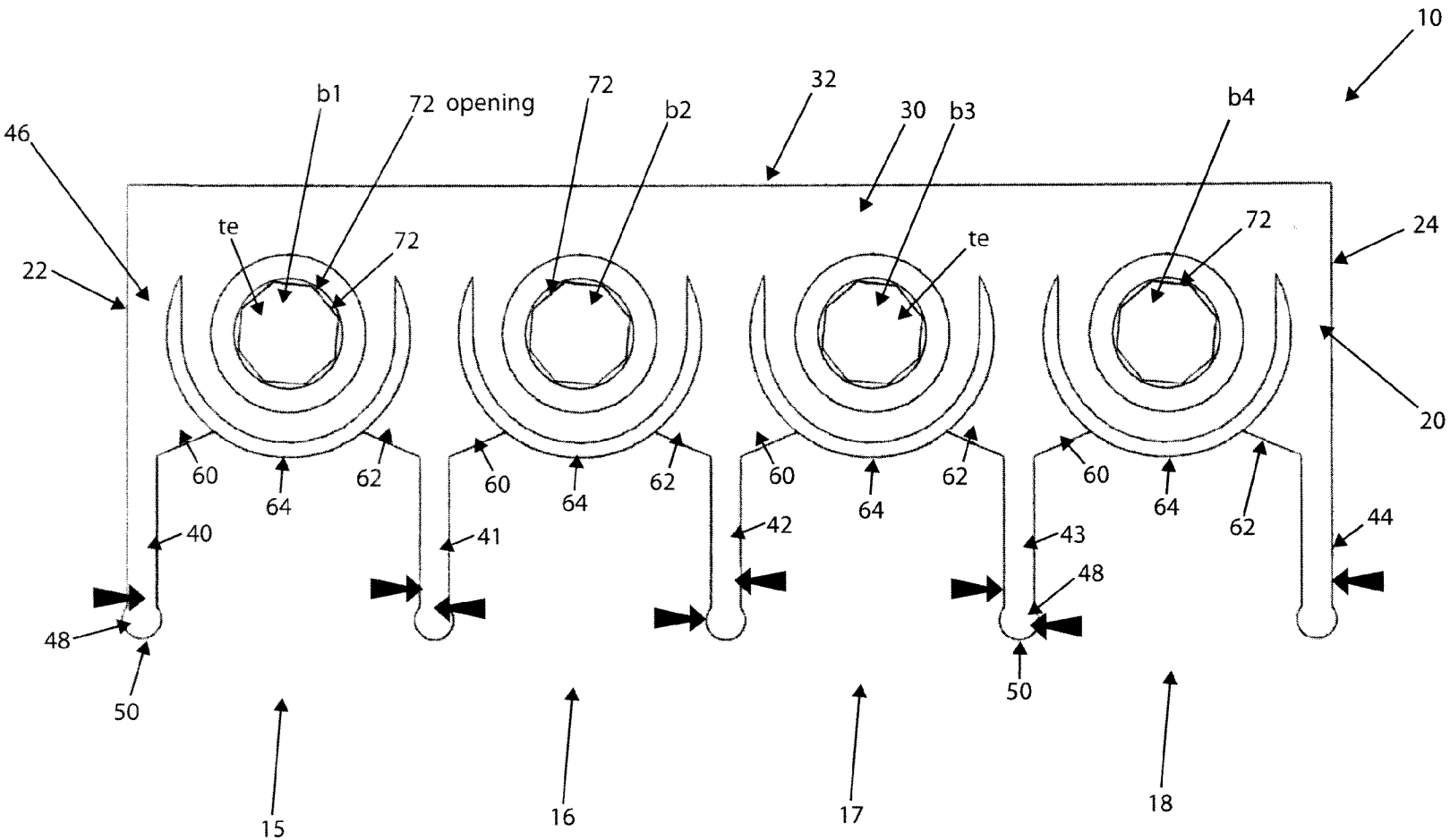
FIG. 3 is a top view of the tool bit holder shown in FIG. 1.
Figure 4:
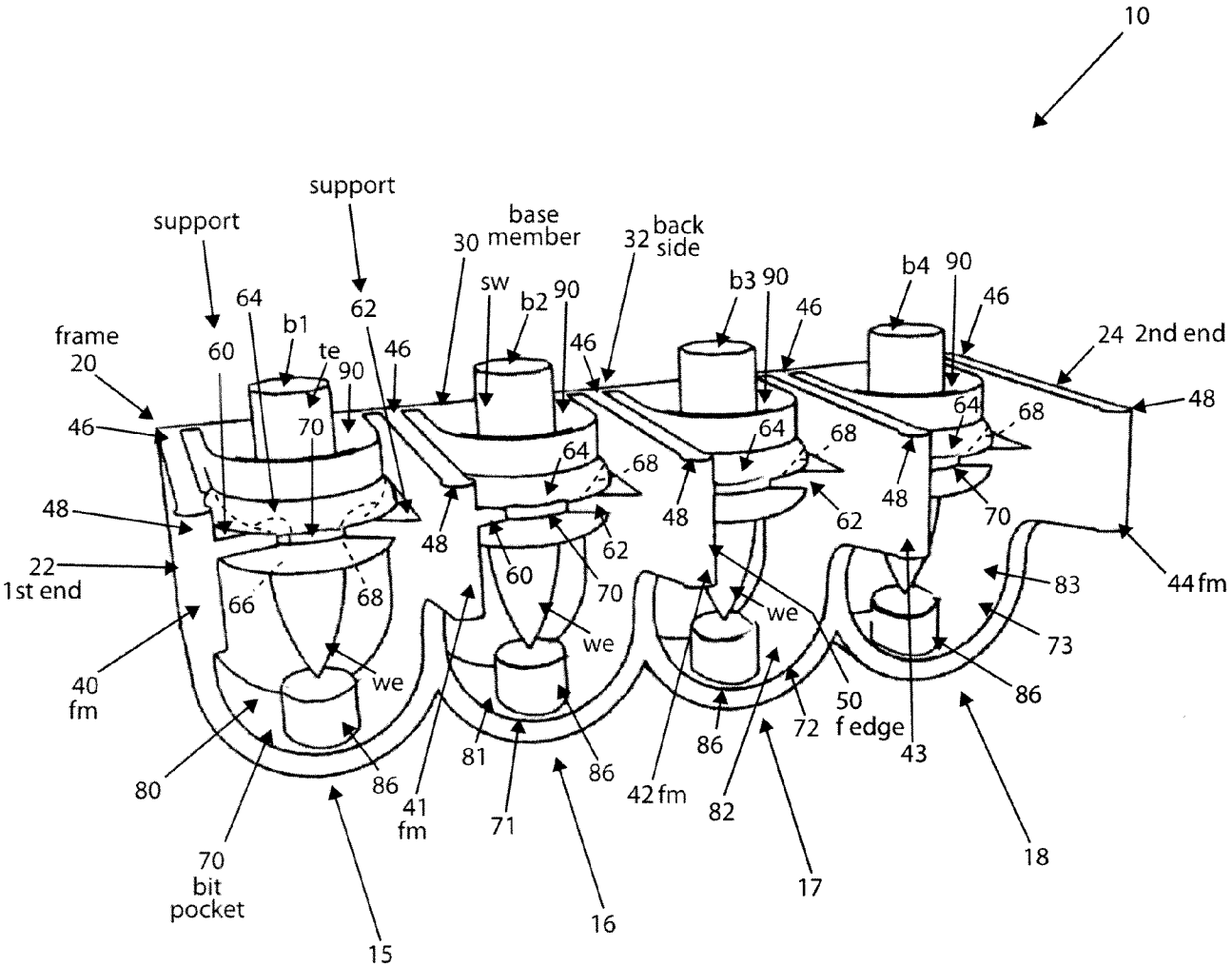
FIG. 4 is a front side perspective view of the tool holder shown in FIG. 1.

Referring now in greater detail to the drawings wherein the showings are for the purpose of illustrating preferred embodiments of the invention only and not for the purpose of limiting the invention, FIGS. 1-4 show a tool bit holder 10 having a four nest configuration wherein holder 10 includes nests 15-18. However, this embodiment and others should not be limited to the particular number of nests shown in the Figures of this application in that these are only representative of the invention and are not intended to be limiting.

Each of these nests are maintained relative to one another and supported by a frame 20 that runs the length of bit holder 10 and from a first end 22 to a second end 24. However, it is to be appreciated that many structures of bit holder 10 have multiple purposes in that the structure described as frame 20 includes portions of the bit holder that are also structural elements of the nests and components of the nests. Frame 20 includes a base member 30 on backside 32 that extends between first and second ends 22 and 24, respectively. Backside 32, in connection with other elements, join nests 15-18 to one another wherein nests 15-18 are configured to releasably support one or more tool bits referenced in these figures as tool bits b1-b4. Again, this and other embodiments are not to be limited to the particular number of nests shown.

Tool bit nests 15-18 each have similar characteristics even though that is not required. In this respect, while all nests can be virtually identical, one or more nests could be modified to receive a different shaped or configured tool bit without detracting from the invention of this application. As is known in the art, there are many types of drives used for tool bits wherein a portion of the nests could be configured to one particular drive while a second portion is configured to a different style drive which could necessitate modifications to the structural elements of one or more particular nests. With respect to the nests shown in these figures, nests 15-18 include flexible members 40-44 which each extend from a base 46 that is joined to base member 30 to a distal end 48 spaced from base member 30 that generally defines front edge 50. As will be discussed in greater detail below, members 40-44 are configured such that distal end 48 flexes relative to its base to at least in part provide the releasable support feature of the invention of this application.

Flexible members 40 and 41 of nests 15 include inwardly facing grommet supports 60 and 62 to support a grommet 64 relative to nests 15. In this respect, supports 60 and 62 include inwardly facing surfaces 66 and 68 and grommet 64 includes a central groove 70 shaped to receive curved inner surfaces 66 and 68 of supports 60 and 62, respectively. This configuration supports grommet 64 relative to nest 15. Grommet 64 can be a wide range of grommets including, but not limited to, a pliable rubber grommet or pliable synthetic grommet configured that is deformable to also in part provide the releasable supporting feature of the invention of this application. Grommet 64 further includes an inner opening 72 shaped to receive a tool bit such as tool bit b1. In this embodiment, nest 15 is in the disengaged position when it is at rest. However, when flexible members 40 and 41 are urged toward one another, nest 15 is transformed into an engaged position. More particularly, as flexible members 40 and 41 move toward one another, supports 60 and 62 are forced against the sides of grommet 64. This action causes grommet 64 to deform wherein opening 72 deforms and provides a frictional force against a side wall SW of bit b1.

As is known in the art, tool bits include a working end such as working end WE which is configured to engage a tooling slot such as a Phillips drive to turn objects such as a fastener. Tool bits further include a tool end such as tool end TE of fastener b1 configured to be received and driven by a tool such as a powered screwdriver. As is also known in the art, the working end and tool end of a tool bit can have a wide range of configurations based on the particular application of use for the tool bit and/or the particular tool that is intended to drive the tool bit. Again, this application is not limited to a particular style of tool bit; however, it has been found to work particularly well with standard hex drive or octagonal drive style tool bits configured for use in a power driver and is therefore being described for use with the same. However, it is not to be limited to any one style of tool bit.

Nests 16-18 also include grommets 64 supported by similar supports 60 and 62 as is discussed in relation to nest 15. These components work similar to the nest 15 wherein each one will not be described in detail in the interest of brevity. However, not all of the flexible members are the same. In this respect, flexible member 40 includes only a single support 60 facing inwardly from first end 22. Similarly, but opposite to, flexible member 44 includes a single support 62 facing inwardly from second end 24. But, flexible members 41-43 include multiple support structures wherein these flexible members are used for both adjacent nests. In this respect, flexible member 41 is used to engage and disengage both nests 15 and 16 wherein flexible member 41 includes support 62 for nest 15 and support 60 or nest 16. Similarly, flexible member 42 includes support 62 for nest 16 and support 60 for nest 17 wherein flexible member 42 is used for both engaging and disengaging nests 16 and 17. In the same fashion, flexible member 43 includes support 62 for nest 17 and support 60 for nest 18 wherein flexible member 43 is used for both nests 17 and 18. As a result of this shared configuration of the flexible members, the design of the tool bit holder 10 is simplified and minimized wherein the overall package configuration of this tool bit is compact and the overall structure of the holder requires less material to produce.

Tool bit holder 10 can further include bit pockets 70-73 for nests 15-18, respectively. These bit pockets can form a portion of frame 20 or can be independent of the support frame and merely a recess for receiving the working end of the respective tool bit. As with all embodiments of the invention of this application, the bit pockets can include a viewing port hole to allow the user of holder 10 to see the working end of the bit. As is discussed throughout this application, tool bits can have a wide range of working ends depending on the particular fastener or other object in which the working end is configured to engage. In this embodiment, nests 15-18 include openings 80-83 that are a form of port hole used to allow the user to view the working end of the respective tool bit. In addition, bit pockets 70-73 can include a tool bit stop 86 configured to limit the axial movement of the respective tool bit through opening 72 of the respective nest. As can be appreciated, if axial movement is unrestricted, a sufficient amount of tool end TE may not protrude out of opening 72 to allow for the tool bit to be grasped and removed from the holder. Similarly, a sufficient amount of tool end TE must protrude from opening 72 if the user is to be able to engage a tool such as a power driver directly to the tool bit when it is positioned in the nest. This allows the user to directly connect to the tool bit while it is in the nest and use the tool to pull the tool bit from the nest.

To help facilitate direct engagement by the tool on the tool bit while in the nest, nests 15-18 can further include a pilot opening 90 facing the tool end of the bit which includes an inner opening shape to partially receive the gripping portion of the tool designed for use in connection with the tool bit. Again, while nests 15-18 are described to be similar to one another, including the components described in connection with each nest being similar to one another, this is not required and the invention of this application is not to be limited to nests having identical or substantially similar configurations.

As a result of this operational configuration, the tool bit holder works as follows. To remove a tool bit from the holder, the user can grasp the tool end of the bit with their fingers (depending on the embodiment) or with the chuck of the tool and simply pull the tool bit from the particular nest. The light frictional engagement or generally zero frictional engagement between the nest of some embodiments and the tool bit of some embodiments allows for the easy removal of the tool bit from the holder. The flexible members are maintained in the released position, as is shown, when the bit is removed. The tool bit can be repositioned within a nest by urging the tool bit through the particular opening until it is positioned in the supportive position as is shown in the figures. Then, the flexible members of the particular nest are squeezed together which increases the frictional engagement between the grommet and the tool bit. Once the frictional engagement is increased by this squeezing, the tool can be easily removed from the tool end of the bit thereby releasing the interengagement between the tool and the bit wherein the bit remains within the holder.

Tool bit holder 10 and other embodiments of the invention of this application can be manufactured using any known techniques. This includes injection molding at least frame 20 of the tool bit holder. More particularly, frame 20 can be a molded product including, but not limited to, an injection molded product formed by any one of, or a mixture of, polymers, rubbers, natural, and/or synthetic flexible materials or even metallic materials that allow for the flexing action for the releasable supporting feature of the invention of this application. Further, the invention of this application can be a unified component formed by a single material. Yet even further, the invention of this application can utilize multiple stage molding techniques designed to mold multiple materials into a unified product such as multiple cavity molds that mold materials over top of other materials. In this particular embodiment, tool bit holder 10 includes a pliable grommet configuration wherein grommets 64 are separate components from frame 20. Further, bit stops 86 can also be co-molded with frame 20 or can be separate components attached to the respective bit pockets.

Figure 5:
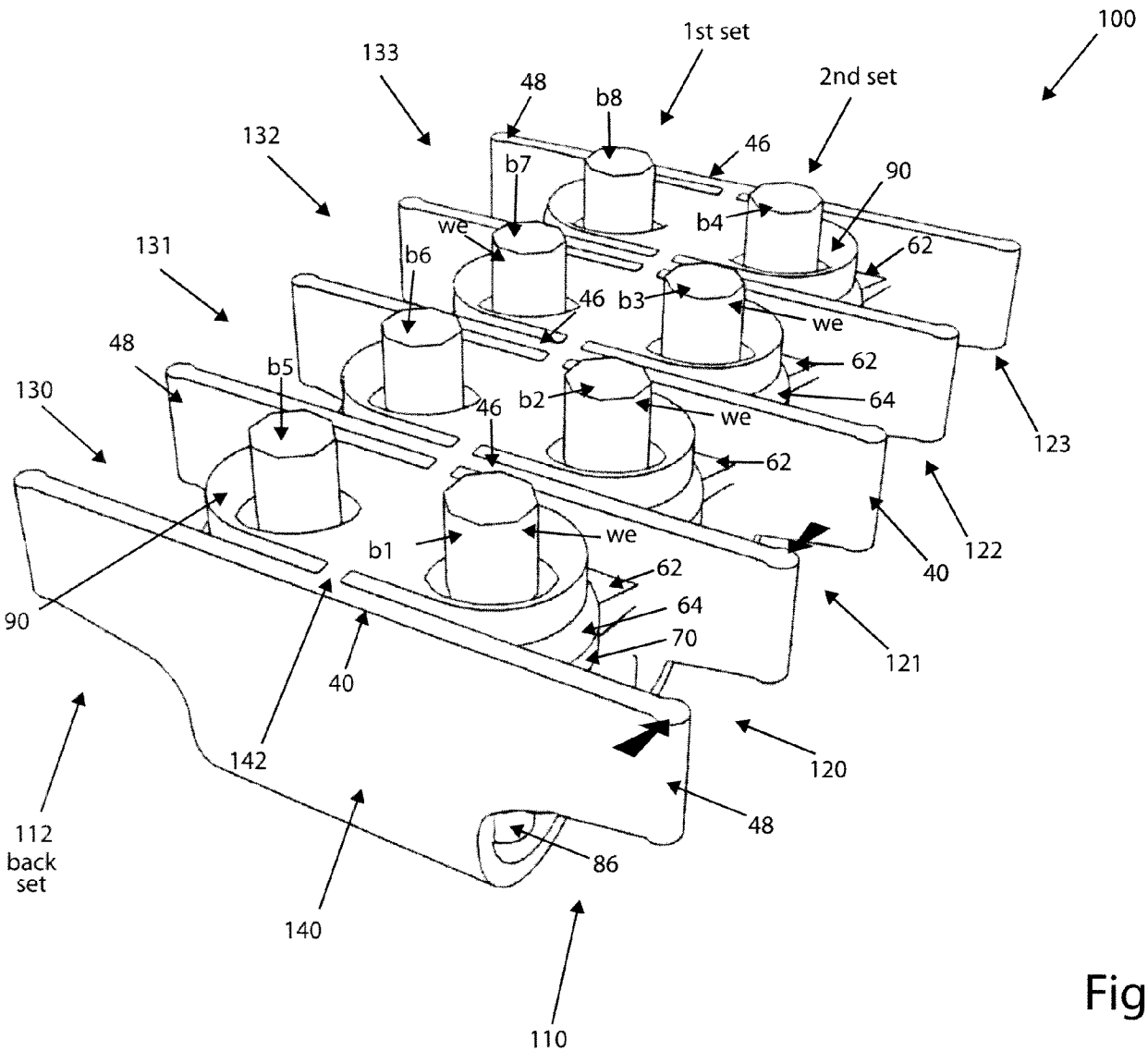
FIG. 5 is a side top perspective view of another embodiment of the tool holder according to the present invention.

With reference to FIG. 5, shown is tool bit holder 100 which is an eight nest tool bit holder which includes a front side or first side set of nests 110 and a backside set of nests 112. In that tool bit holder 100 includes the same nest arrangements as tool bit holder 10, each particular nest will not be described in detail in the interest of brevity. Tool bit holder 100 includes nests 120-123 in front side set 110 and nests 130-133 in backside set 112. However, tool bit holder 110 includes a frame 140 that has a base member 142 that is shared by both front set 110 and back set 112. Further, the respective bit pockets can also include shared components from the front side and the backside as is shown in FIG. 5. In that each of the nest sets includes four nests, bit holder 100 is configured to releasably support tool bit b1-b8. Again, more or less nests could be included in bit holder 100 without detracting from the invention of this application.

Figure 6:
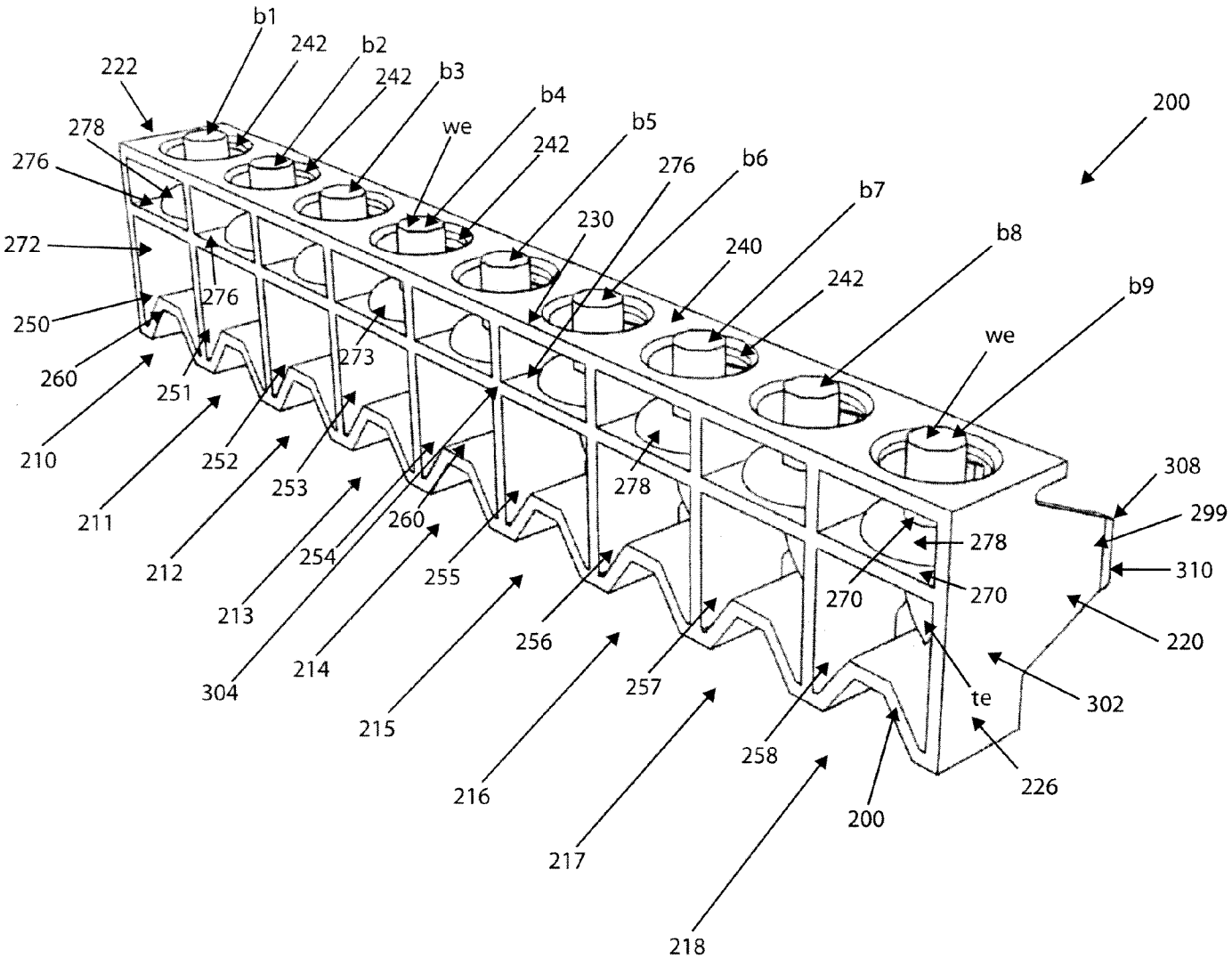
FIG. 6 is a side top perspective view of yet another embodiment of the present invention.
Figure 7:
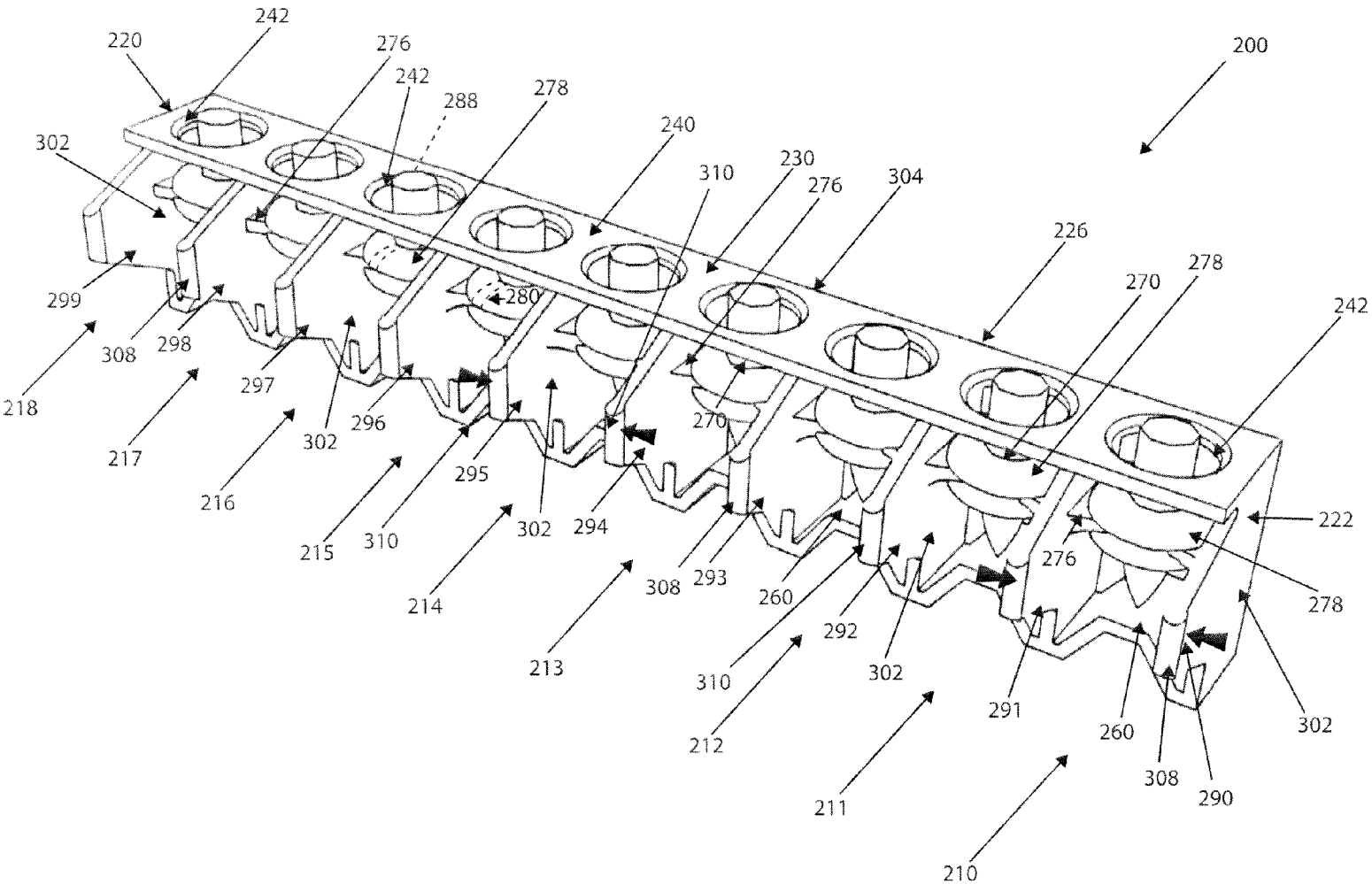
FIG. 7 is a rear perspective view of the tool holder shown in FIG. 6.
Figure 8:
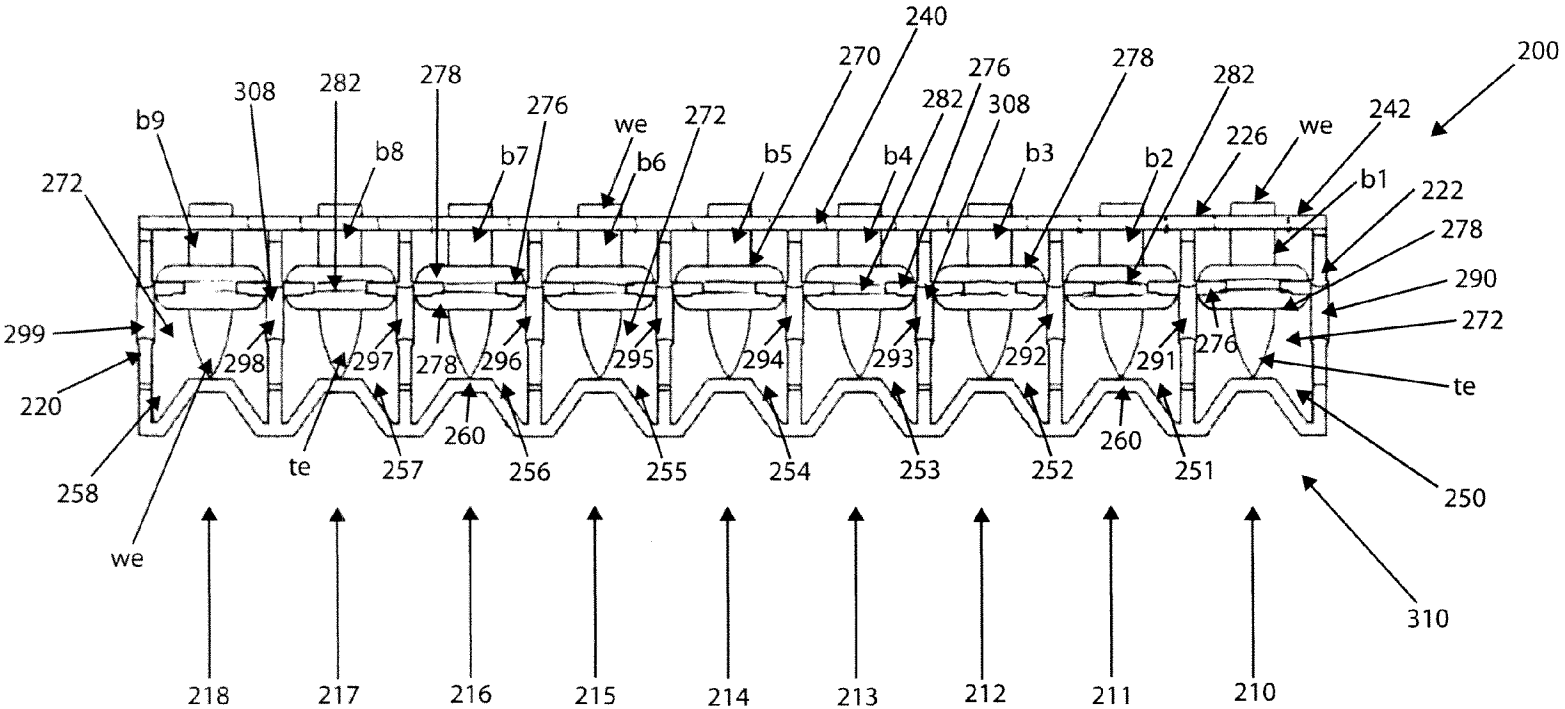
FIG. 8 is a rear side view of the tool holder shown in FIG. 6.

With reference to FIGS. 6-8, shown is tool bit holder 200 which is a nine nest tool bit holder including nests 210-218. These nests are configured to support tool bits b1-b9, respectively, and extend from a first end 220 to a second end 222. Bit holder 200 has a frame 226 that extends between ends 220 and 222 with a base member 230 that is structurally different from the previously discussed tool bit holders. In this respect, frame 226 of holder 200 is a box-like structure including a top member 240 extending between ends 220 and 222 that includes pilot openings 242 for each of nests 210-218. Tool bit holder 200 further includes bit pockets 250-258 for nests 210-218, respectively. While these bit pockets perform generally similar to the pockets described above, bit pockets include a different configuration for the tool bit stops. In this respect, bit pockets 250-258 include an inverted, generally U-shaped bottom wall 260 that also functions as a tool bit stop. Again, this limits axial motion of the tool bit relative to an opening 270 of each nest 210-218 as discussed above. As with other bit pockets, nests 210-218 can include a viewing port hole 272 to again allow the end user to view the working end of the particular tool bit. In this particular embodiment, port hole 272 is an opening in the bit pocket. However, it should be appreciated that a transparent or substantially transparent material could be used in connection with this porthole to allow viewing of working end WE without the necessity of having an opening in the bit pocket. Nests 210-218 each further include a grommet support 276 to support grommets 278. In this particular embodiment, support 276 is a single support having an inwardly facing curved surface 280 that extends greater than 180° around the tool bit axis thereby allowing recess 282 of grommet 278 to be snapped into place and retained by supports 276.

Tool bit holder 200 further includes flexible members 290-299 that each extend from a base portion 302 that is joined to frame 220 near a backside 304. Flexible members 290-299 extend forwardly from region 302 to a distal end 308 which at least in part forms a front side 310.

In this embodiment, the tool bit holder is in a disengaged position when released and as is shown. In this position, the grommet can be configured to provide a light frictional engagement between the opening in the grommet and the tool bit to reduce the likelihood that the tool bit inadvertently falls from the holder. Then, as the flexible members are squeezed toward one another, the members deform grommet 278 between the members which in turn deforms opening 270 and increases the frictional engagement between the opening and the tool bit as is discussed in greater detail above.

Figure 9:
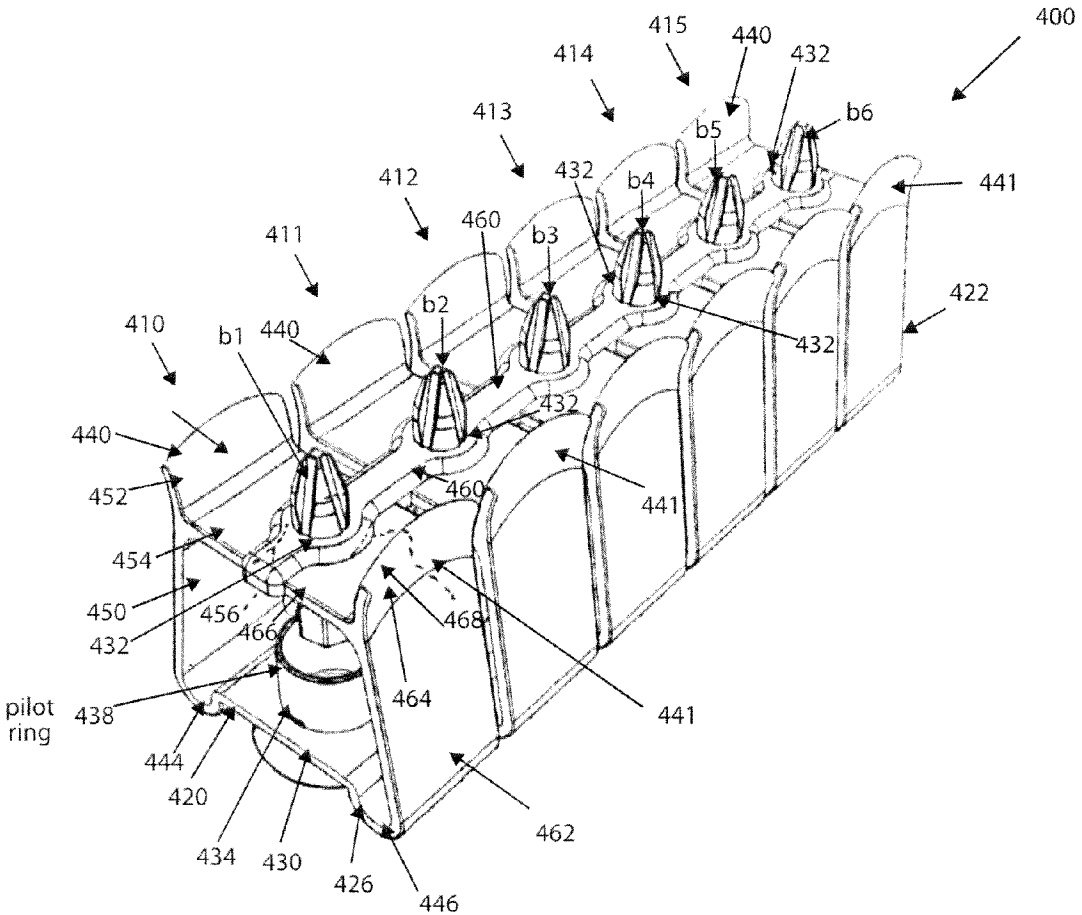
FIG. 9 is a perspective view of a further embodiment of the invention of this application.
Figure 10:
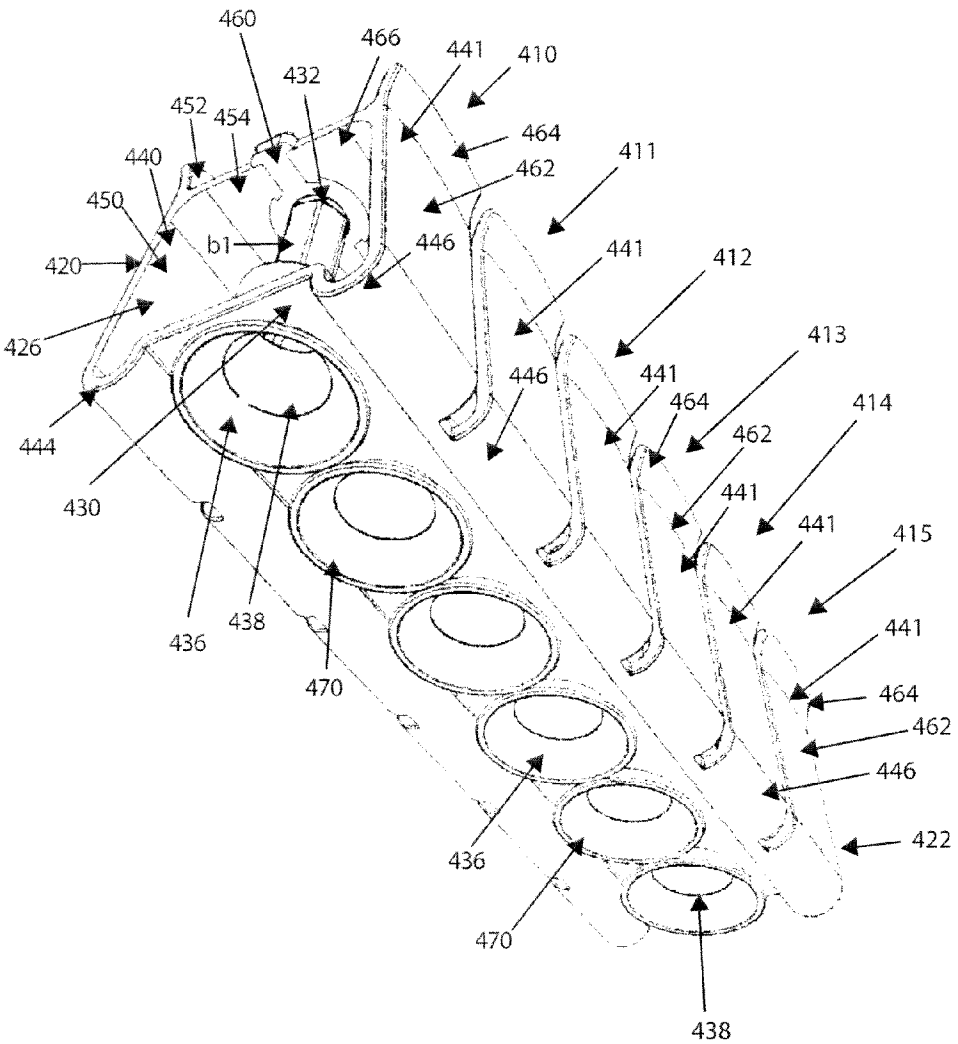
FIG. 10 is a bottom perspective view of the tool holder shown in FIG. 9.
Figure 11:
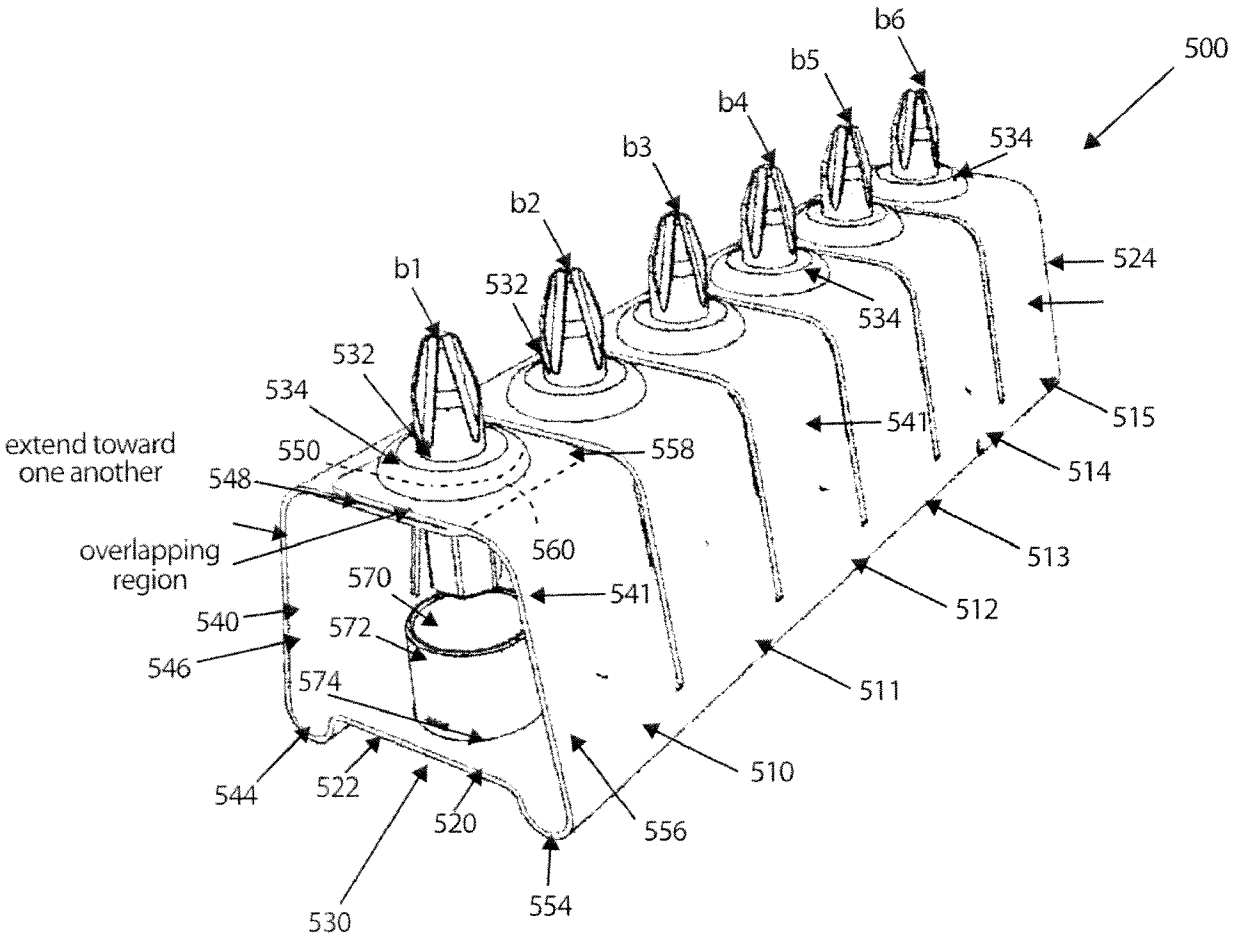
FIG. 11 is a top side perspective view of yet a further embodiment of the invention of this application.
Figure 12:
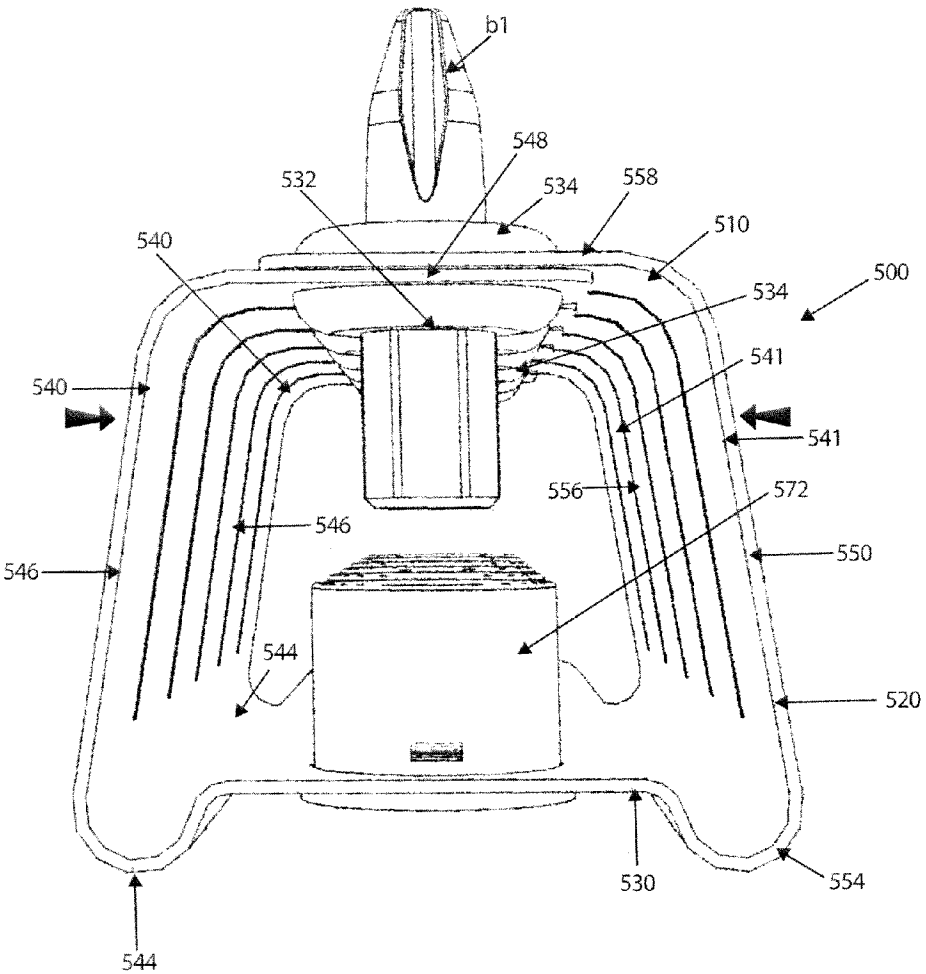
FIG. 12 is an end view of the tool holder shown in FIG. 11.
Figure 13:
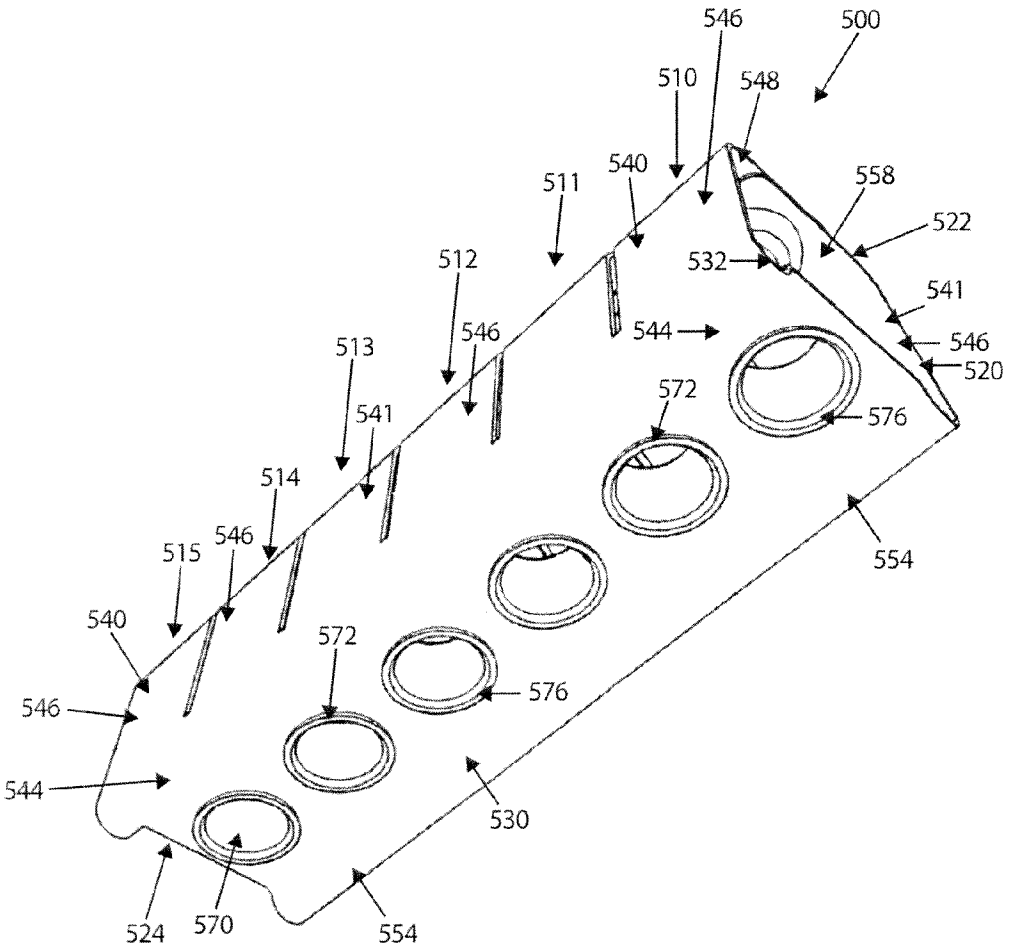
FIG. 13 is a bottom perspective view of the tool holder shown in FIG. 11.
Figure 14:
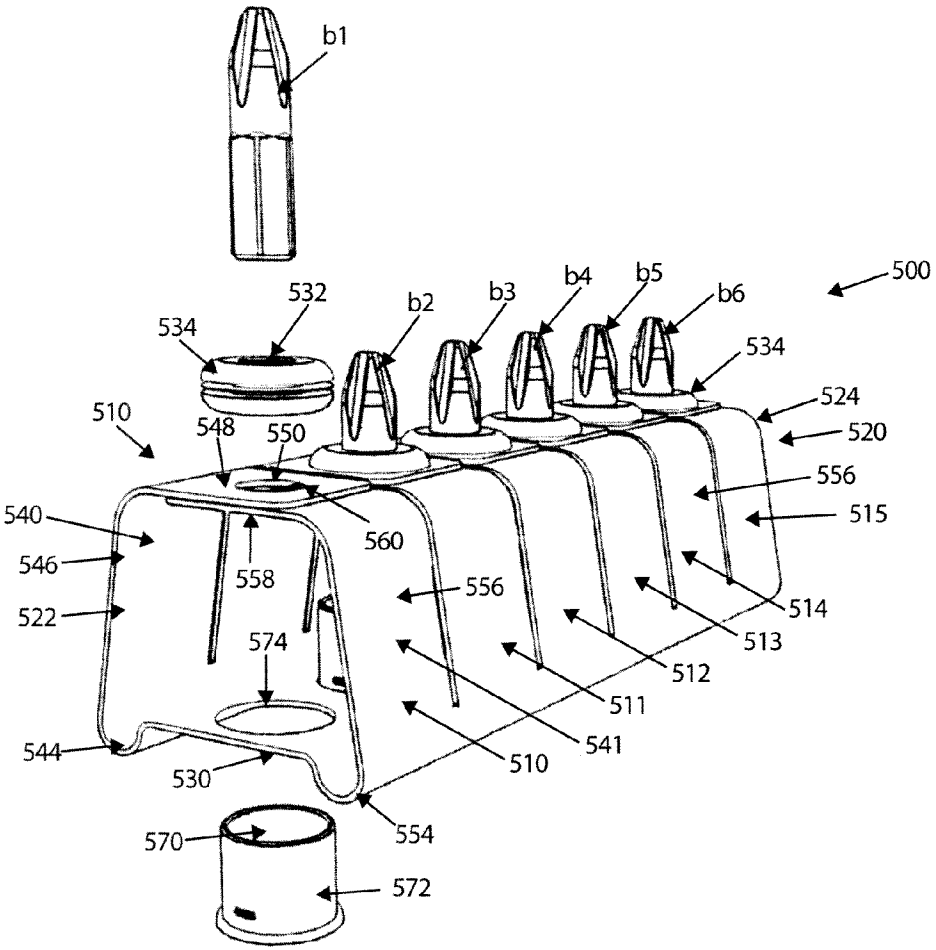
FIG. 14 is a partially exploded perspective view of the tool holder shown in FIG. 11.

With reference to FIGS. 9 and 10, shown is a tool bit holder 400 which is a six nest tool bit configuration having nests 410-415. Tool bit holder 400 includes a first end 420 and a second end 422 wherein a frame 426 extends between ends 420 and 422 in a longitudinal direction. In this particular embodiment, frame 426 includes a base 430 that is axially spaced from openings 432 in the respective nests.

Each nest includes a pilot opening 434 in base region 430 that can include a pilot ring 438 that can be co-molded with frame 426 or which can be a separate component that can be attached to frame 426 by any means known in the art including, but not limited to, a snap fit or a press fit configuration. As can be appreciated, adhesives could also be used to facilitate the permanent joining between the frame and the pilot ring. These openings and/or rings can further include a tapered opening 436.

Nests 410-415 further include flexible members that function similar to those discussed above with respect to other embodiments but which are configured differently. In this respect, nests 410 include flexible members 440 and 441 that extend upwardly from base 430 of frame 426. These upwardly extending members can include a flexing curvature 444 and 446, respectively, which can be used to control the flexibility characteristics of these members and the inward force produced by these members when they are in the relaxed condition as is shown.

Member 440 includes an upwardly extending element 450 extending from curvature region 444 to a finger tab 452. As will be discussed in greater detail below, finger tab 452 can be used to apply an inward pressure on the particular nest to help control the frictional engagement between the nest and tool bit b1. Flexible member 440 further includes an inwardly extending support section 454 having an inward facing surface 456 configured to engage a grommet 460 having an opening 432 for each nest. In this particular embodiment, the grommet is an elongated grommet generally extending between ends 420 and 422.

Similar to member 440, member 441 includes an upper extending element 462 extending between curvature region 446 and a finger tab 464. Member 441 further includes an inwardly extending section 466 having inwardly facing surface 468 for engagement with grommet 460. As with other embodiments of this application, squeezing flexible members 440 and 441 together urges surfaces 456 and 468 toward one another, thereby deforming opening 432. This results in an increase in the frictional engagement between the grommet and the tool bit thereby locking these two components together. As was discussed above, when the tool bit is placed in the particular nest, the tool bit is forced through one of openings 432 and then flexible members 440 and 441 can be squeezed together so that the tool can be removed from the tool bit by pulling the tool away from the bit and out of the pilot opening in the particular nest. By increasing the frictional engagement between the tool bit and the nest, the bit can be more easily removed from the tool when the user is done with the particular bit. Since each of the nests in this embodiment generally function the same, each nest will not be discussed separately in the interest of brevity.

With reference to FIGS. 11-14, shown is a tool bit holder 500 having six nests 510-515 for supporting tool bits b1-b6, respectively. Again, while a single type of tool bit is shown, this application and each embodiment is not to be interpreted as being limited to a particular tool bit. Too bit holder 500 includes an elongated frame 520 extending between ends 522 and 524. Frame 520 further includes a base 530 that is axially spaced from a tool bit opening 532 and each nest includes a grommet 534. While not necessary, each of nests 510-515 include the same grommet 534 with an opening 532. With respect to the nests, each nest includes a pair of flexible members 540 and 541 wherein flexible member 540 includes a curved flexing region 544 joining an upward element 546 to base 530. Flexible member 540 further includes an inwardly extending section 548 that includes a grommet opening 550 shaped to receive and maintain grommet 534 of the tool bit holder.

Similarly, flexible member 541 includes a curved flexing region 554 joining an upward extending element 556 to base 530. Flexible member 541 further includes an inwardly extending section 558 which includes grommet opening 560 also shaped to receive and retain grommet 534. However, it should be appreciated that both inwardly extending regions do not need to fully retain and hold the grommet in position. Inwardly extending sections 548 and 558 are in sliding engagement with one another such that squeezing members 540 and 541 together can alter the shape of opening 532.

In one embodiment, the frictional engagement between opening 532 and tool bit b# is increased when members 540 and 541 are squeezed together. In another embodiment, the frictional engagement between the opening and the tool bit is reduced when these members are squeezed together. These differences in the embodiments can be utilized to customize the actuation of the tool bit holder without detracting from the invention of this application. As with other embodiments in this application, the opening in the grommet that receives the tool bit can be deformed by the sliding action caused by the actuation of the flexible members wherein the force applied by squeezing the flexible members can be translated to the tool bit by way of the grommet.

Each nest 510-515 can further includes a pilot opening 570 in base region 530 that can include a pilot ring 572. As with other embodiments, ring 572 can be co-molded with frame 520 or which can be a separate component that can be attached to frame 520 in a hole 574 by any means known in the art including, but not limited to, a snap fit, a press fit configuration or by adhesives or friction welding. Pilot opening 570 and/or ring 572 can also include a ramping region 576 to help align the tool bit in opening 570.

Again, each nest in tool bit holder 500 can be generally the same or could be configured to work in connection with a different size and/or configuration of tool bit such, but not limited to, a different working end WE. In this particular embodiment, each nest is configured generally the same as the remaining nest whereby further discussion with relation to nests 511-515 is not being articulated in the interest of brevity.

Figure 15:
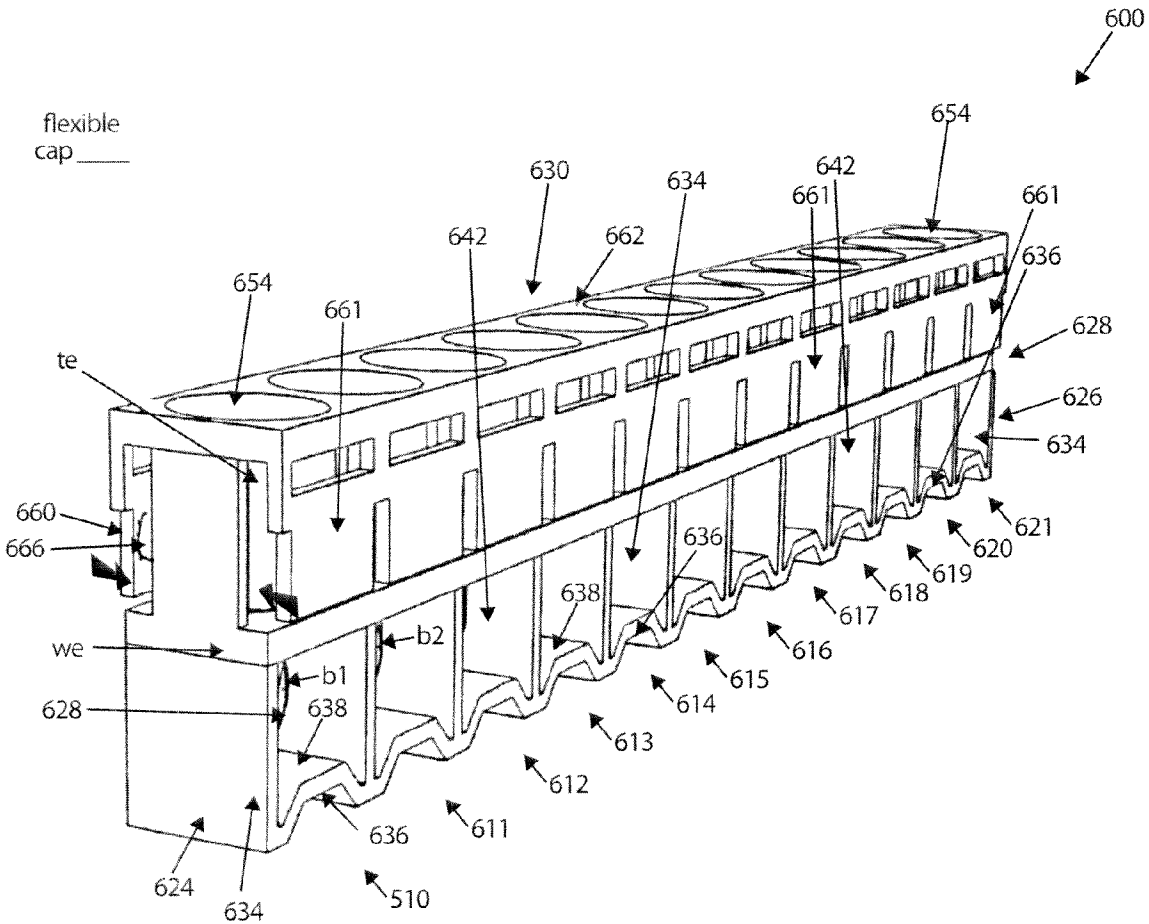
FIG. 15 is a top side perspective view of yet another embodiment of the invention of this application.
Figure 16:
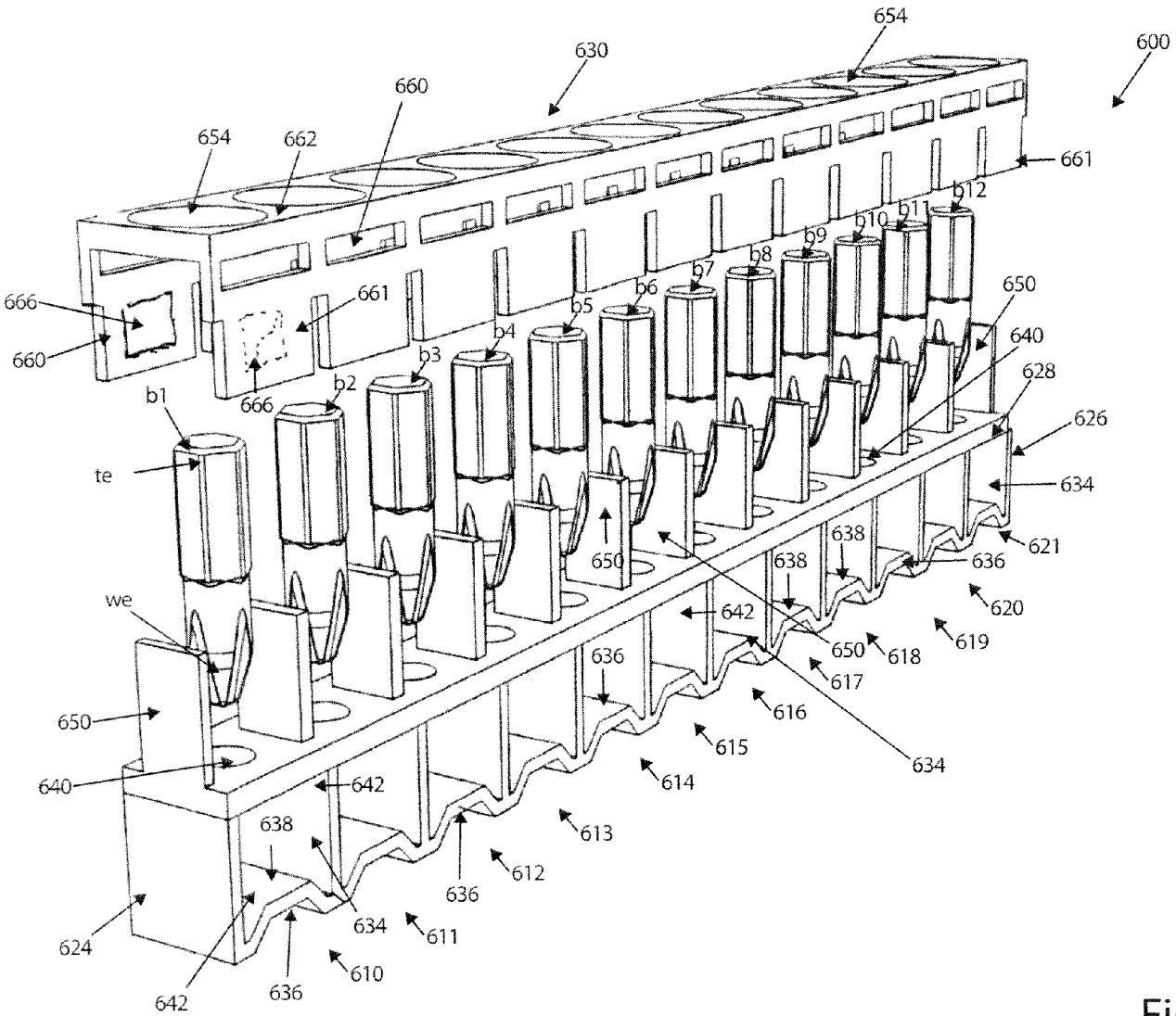
FIG. 16 is an exploded perspective view of the tool holder shown in FIG. 15.
Figure 17:
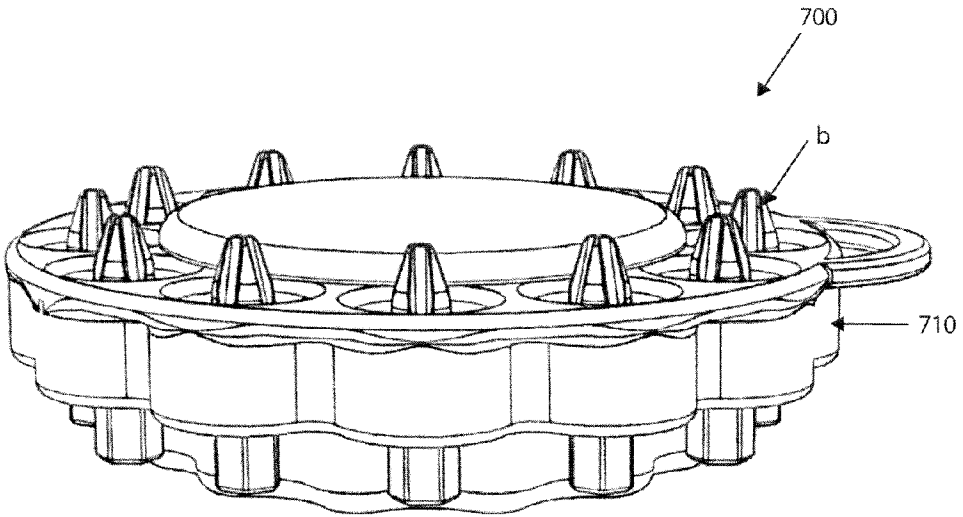
FIG. 17 is a top side perspective view of yet a further embodiment of the invention of this application.
Figure 18:
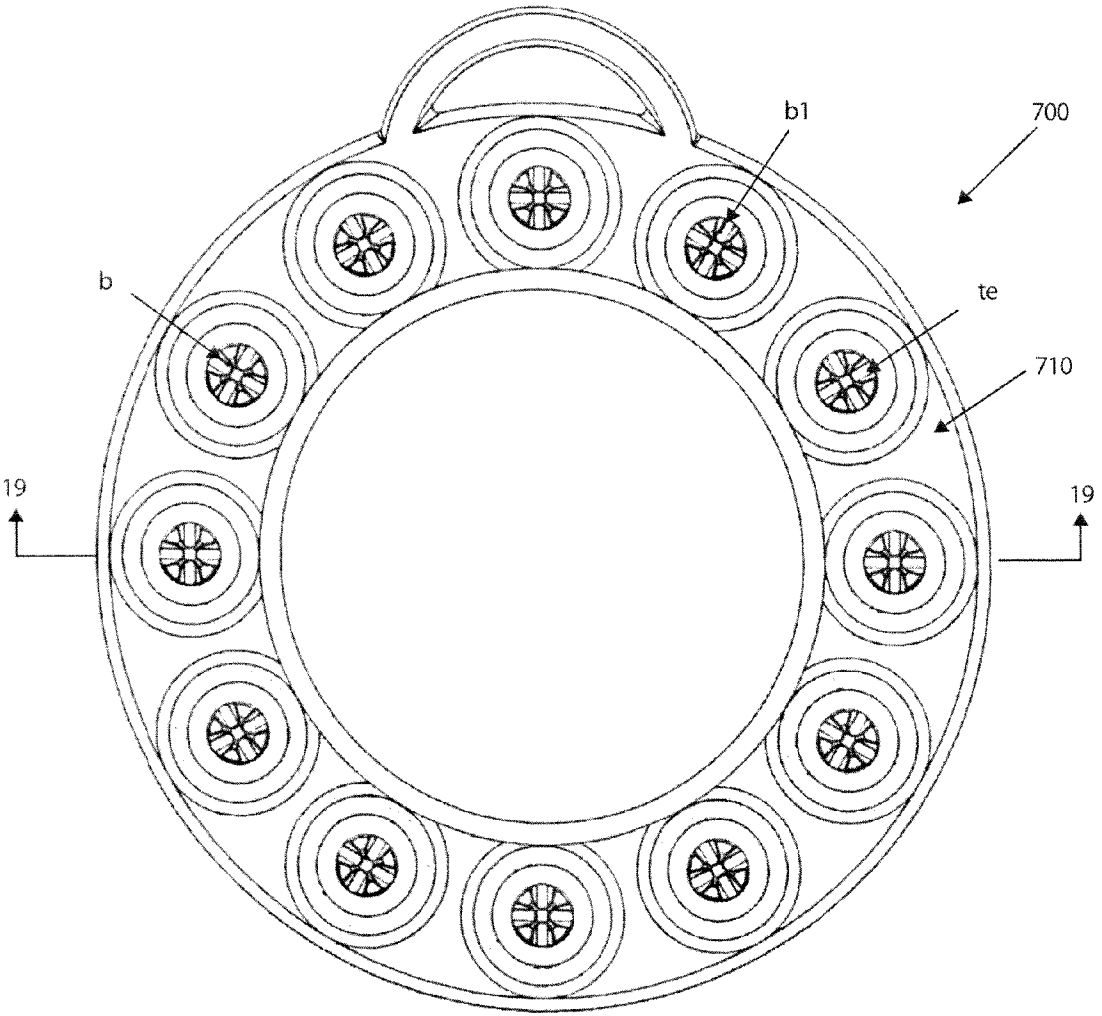
FIG. 18 is a top view of the tool holder shown in FIG. 17.
Figure 19:
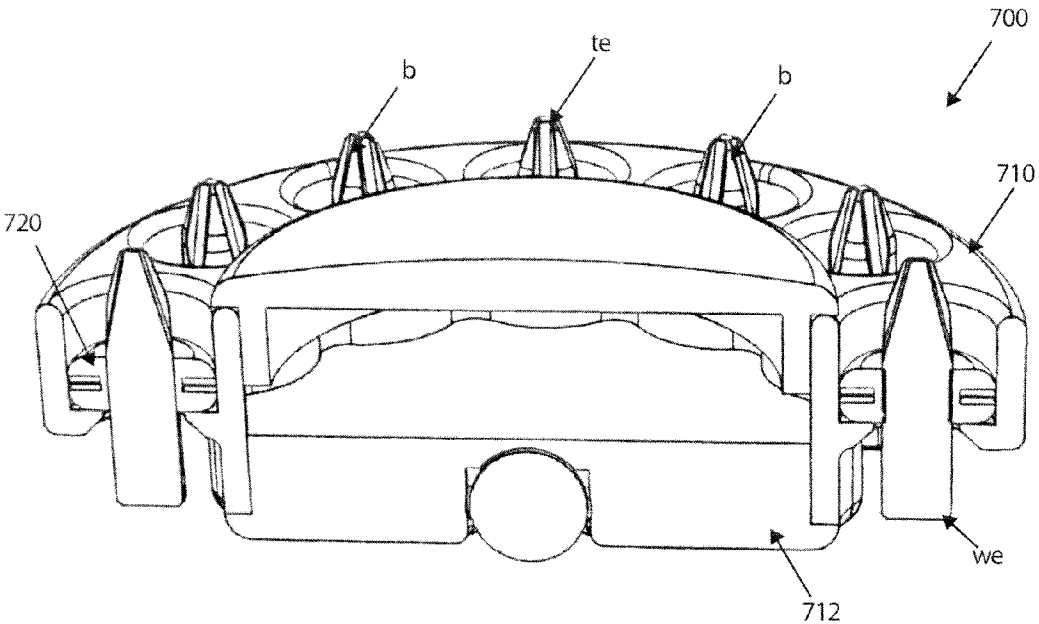
FIG. 19 is a sectional view taken along line 19-19 in FIG. 18.
Figure 20:
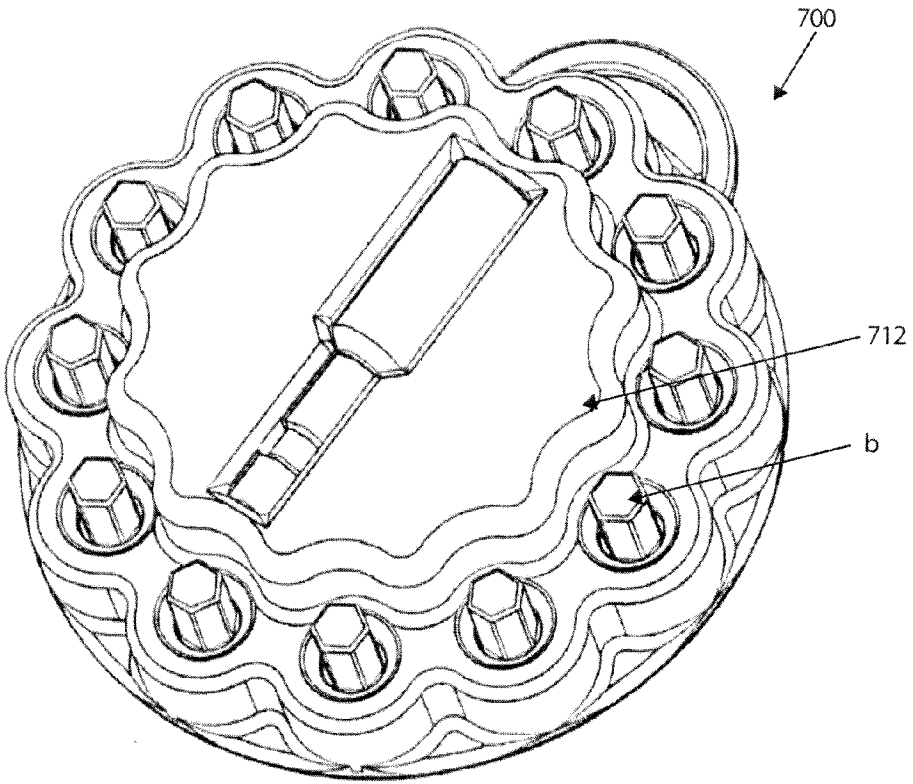
FIG. 20 is a bottom perspective view of the tool holder shown in FIG. 17; and, FIG. 21 is a partially exploded perspective view of the tool holder shown in FIG. 17.
Figure 21:
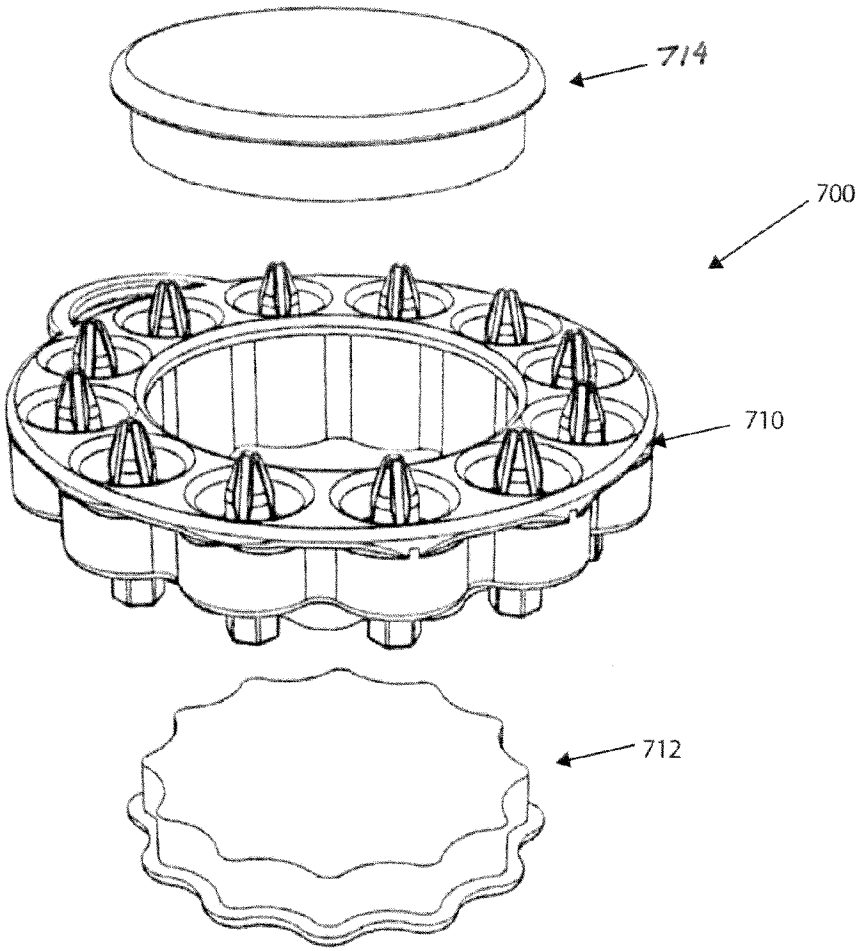

With reference to FIGS. 15 and 16, shown is a tool bit holder 600 which includes 12 nests, 610-621. Holder 600 extends between a first end 624 and a second end 626 wherein holder 600 has an elongated frame 628 extending between ends 624 and 626. Holder 600 further includes a flexible cap member 630 that interengages with frame 628 to form tool bit holder 600 and which will be discussed in greater detail below. Again, in this embodiment, the nests are generally configured the same wherein in the interest of brevity, a single nest will be discussed and this discussion applies equally to all nests. Again, it is also important to understand that each nest does not need to be the same, and further that an embodiment of the invention of this application can include more than one nest configuration described in this application including equivalence thereof.

With respect to holder 600, each nest includes a bit pocket 634 joined to frame 628 that includes a base portion 636 having a generally, inverted U-shaped configuration, forming a bit stop 638. As is discussed above, bit stop 638 can be used to limit the axial movement of the tool bit such that the tool end of the tool bit remains exposed thereby allowing the bit to be grasped by one's fingers or by the receiving end of a hand tool such as a power driver. Nest 610 further includes a nest opening 640 shaped to receive tool bit b1. In this embodiment, opening 640 is a non-formable and non-frictional opening that can be shaped and sized to allow the free axial movement of b1 relative to frame 628. However, in another embodiment, opening 640 can be configured to provide a slight resistance fit between the tool bit and the frame to allow the removal of the tool bit from holder 600 but which prevents the tool bit from inadvertently falling from the particular nest.

Bit pockets 634 can further include at least one porthole 642 thereby allowing the user to view working end WE of the tool bit when it is in the supported position shown in FIG. 15. As with the other embodiments of this application, this porthole can be an opening or can be a transparent section within the pocket to accomplish this goal. Frame 628 further includes stanchions 650 that extend upwardly to allow cap member 630 to be joined to frame section 628. This interengagement can be achieved by any means known in the art including, but not limited to, use of adhesives, locking arrangements, heat welding, and/or fasteners. By utilizing stanchions 600, cap member 630 is properly spaced from the frame to allow for the desired amount of coverage of the tool bit. In this respect, the stanchions can be configured to completely cover the tool bit including the tool end of the bit thereby further preventing the tool bit from inadvertently falling from the holder without the need for frictional engagement between the tool bit and the holder. Cap member 630 can include a pilot opening 654 for each nest sized to allow the tool holding portion of an associated driver to pass therethrough and engage tool end TE of bit b1.

Top section 630 further includes downwardly extending flexible members 660 and 661 that downwardly extend from a top planar section 662 of cap 630. As is shown, opening 654 can be in section 662. Flexible member 660 and 661 can be squeezed together by the user such that frictional engagement surfaces 666 and 668 can be selectively engaged against the elongated outer surface of b1. When engaged against the outer surface, these frictional surfaces can prevent axial movement of the tool bit to allow the bit to be removed from the tool. Then, when in the relaxed condition shown, the frictional engagement is released and the tool bit can be removed from the tool bit holder by the working end of the driver. In one embodiment, the entire top section 630 can be formed by a resilient material wherein the frictional properties needed to engage the tool bits are molded into the entire component. For example, this component could be molded from a low durometer material having a high coefficient of friction that is also flexible thereby allowing the flexibility of flexible member 660 and 661 and also producing the necessary frictional engagement between these flexible members and the tool bit.

With reference to FIGS. 17-21, shown is tool bit holder 700 which is in a circular configuration as opposed to the elongated configurations described above. Holder 700 can utilize any one of the tool holding configurations described above or even a combination thereof in this circular configuration. Further, tool bit holder 700 can have a frame 710 which a rotational base member 712 that can rotate relative to frame 710 to proved the necessary compression of grommets 720. As is discussed above in greater detail, the compression of a grommet can be used to increase the frictional engagement between the grommet and thus the nest and the too bit. Further, grommet 720 can maintain a desired minimal frictional engagement when base member 712 is returned to the position shown in the figures. This is a form of "indirect" contact between the flexible member and the user's fingers. In this respect, as is shown in the embodiments above, the flexible members are directly engaged by the user's fingers wherein the flexible members are squeezed to produce the frictional engagement between the particular nest and the tool bit for the releasable support therebetween. In this embodiment, the compression of the grommet is produced by rotation of the central member 712. Further, this rotation compresses all grommets at one time as opposed to the nest by nest compression configurations described above.

While considerable emphasis has been placed on the preferred embodiments of the invention illustrated and described herein, it will be appreciated that other embodiments and/or equivalents thereof can be made and that many changes can be made in the preferred embodiments without departing from the principles of the invention. Accordingly, it is to be distinctly understood that the foregoing descriptive matter is to be interpreted merely as illustrative of the invention and not as a limitation.

It is claimed:

1. A tool bit holder for releasably supporting a plurality of tool bits in a supported position and wherein each tool bit has an elongated bit body extending from a working end to a tool end wherein the tool end of the tool bit is shaped to receive a tool and the working end is shaped to engage a fastener each tool bit has an elongated side wall extending between the working and tool ends, said tool bit holder comprising a frame including a plurality of spaced bit receiving nests, each of said nests having a bit opening shaped to receive one associated tool bit, each of said nests further including a flexible member movable relative to said bit opening and movable between an engaged position and a disengaged position, each of said nests designed to engage the elongated wall of one tool bit when a tool bit is position in said nest, said flexible member designed to inhibit or prevent relative movement between said nest and the tool bit when said flexible member is in said engaged position, said flexible member designed to allow relative movement between said nest and the tool bit when said flexible member is in said disengaged position, said flexible member including an inwardly facing surface, said inwardly facing surface designed to move toward the elongated wall of the tool bit when the tool bit is position in said nest and when said flexible member is moved from said disengaged position to said engaged position, said movement of said inwardly facing surface toward the elongated wall of the tool bit is designed to increase frictional engagement of said nest with the elongated wall of the tool bit to thereby inhibit or prevent removal of the tool bit from said nest when said flexible member is moved to said engaged position.

2. The tool bit holder according to claim 1, wherein said bit opening is at least partially formed of a pliable grommet in said nest, said grommet including an inwardly facing grommet surface defining at least a portion of said bit opening, said grommet surface being adjacent to the elongated side wall of the tool bit when the tool bit is in said supported position, said inwardly facing surface of said flexible member designed to deform said grommet surface when said flexible member is moved from said disengaged position to said engaged position such that said grommet surface frictionally engages the elongated surface of the tool bit thereby inhibiting or preventing said relative movement.

3. The tool bit holder according to claim 2, wherein said pliable grommet frictionally engages the elongated side wall of the tool bit when said flexible member is in said engaged position and said disengaged position, said frictional engagement in said engaged position being greater than said frictional engagement in said disengaged position.

4. The tool bit holder according to claim 3, wherein said flexible member includes two inwardly facing surfaces that are positioned about said bit opening.

5. The tool bit holder according to claim 1, wherein said flexible member includes two inwardly facing surface that are positioned about said bit opening.

6. The tool bit holder according to claim 1, wherein each said nest includes a base member, said flexible member including two flexible transverse arms extending from said base, each of said flexible transverse arms positioned on either side of said bit opening, at least one of said flexible transverse arms including one said inwardly facing surfaces.

7. The tool bit holder according to claim 1, wherein said plurality of spaced bit receiving nests is at least four nests.

8. The tool bit holder according to claim 1, wherein each of said nests further includes a pilot opening axially aligned with said bit opening, said pilot opening being sized to allow partial penetration of the tool bit.

9. The tool bit holder according to claim 8, wherein said pilot opening is a unified component with said frame.

10. The tool bit holder according to claim 1, wherein said engagement of the elongated wall of the tool bit is spaced from the tool and the working end.

11. The tool bit holder according to claim 4, wherein said said grommet is supported by inwardly facing surface of at least one of said flexible members.

12. A tool bit holder for releasably supporting a plurality of tool bits in a supported position and wherein each tool bit has an elongated bit body extending from a working end to a tool end wherein the tool end of the tool bit is shaped to receive a tool and the working end is shaped to engage a fastener each tool bit has an elongated side wall extending between the working and tool ends, said tool bit holder comprising a plurality of nests in spaced relationship to one another, each of said nest including a bit opening that is radially spaced from a bit opening of an adjacent nest, each of said bit openings being deformable between a relaxed condition and a deformed condition, each of said bit openings being shaped to receive a single tool bit when in said relaxed condition and restricting axial movement of the tool bit when in said deformed condition, each of said nests further including a flexible member movable relative to said bit opening wherein said flexible member is moveable between an engaged position and a disengaged position, said opening being in said deformed condition when said flexible member in said engaged position and said opening being in said relaxed condition when said flexible member is in said disengaged position, said flexible member designed to inhibit or prevent relative movement between said nest and the tool bit when said flexible member is in said engaged position, said flexible member designed to allow relative movement between said nest and the tool bit when said flexible member is in said disengaged position, said flexible member including an inwardly facing surface, said inwardly facing surface designed to move toward the elongated wall of the tool bit when the tool bit is position in said nest and when said flexible member is moved from said disengaged position to said engaged position, said movement of said inwardly facing surface toward the elongated wall of the tool bit is designed to increase frictional engagement of said nest with the elongated wall of the tool bit to thereby inhibit or prevent removal of the tool bit from said nest when said flexible member is moved to said engaged position.

13. The tool bit holder according to claim 1, wherein said frame extends from a first end to a second end in a longitudinal direction and said bit receiving nest are longitudinally spaced nests along a center line of said frame, said frame including a base portion extending in said longitudinal direction between said first and second ends, said flexible member of said each of said nests including a pair of flexible components extending upwardly from said base portion on either side of said center line and each including an inwardly facing surface such that the inwardly facing surface of said pair of flexible components face one another, said inwardly facing surfaces engaging a resistance member held therebetween, said resistance member forming a selective resistance fit between said nest and the tool bit located in said nest, said pair of flexible members designed to increase said resistance fit thereby producing said engaged position when said flexible members are pushed together.

14. The tool bit holder according to claim 13, wherein said central line is centered within said frame.

15. The tool bit holder according to claim 13, wherein said flexible components are curve inwardly toward said center line.

16. The tool bit holder according to claim 13, wherein said flexible members each include a curved joint connecting said flexible member to said base portion.

17. The tool bit holder according to claim 13, wherein each said flexible component includes a finger tab at a distal end of said flexible component.

18. The tool bit holder according to claim 17, wherein said finger tabs are above said inwardly facing surfaces.

19. The tool bit holder according to claim 13, wherein said base portion includes an opening coaxial with said nest allowing access to the working end of the tool bit.

20. The tool bit holder according to claim 19, wherein said opening is a pilot opening having a tapered edge.

21. The tool bit holder according to claim 20, wherein said pilot opening includes a collar extending from said based and shaped to guidingly receive the tool into said nest.

22. The tool bit holder according to claim 13, wherein said resistance member is an elongate grommet having a nest opening.

23. The tool bit holder according to claim 22, wherein said elongate grommet having is supported by said an inwardly facing surfaces.

24. The tool bit holder according to claim 13, wherein said pliable grommet frictionally engages the elongated side wall of the tool bit when in said engaged position and when in said disengaged position, said frictional engagement in said engaged position being greater than said frictional engagement in said disengaged position such that relative movement of the tool is restricted when in said disengaged position.

25. The tool bit holder according to claim 1, wherein said frame extends from a first end to a second end in a longitudinal direction and said bit receiving nest are longitudinally spaced nests along a center line of said frame, said frame including a base portion extending in said longitudinal direction between said first and second ends, said tool bit holder being configured to support an associated tool bit such that the tool end in positioned near said base portion, said base portion including a base opening coaxial with said nest allowing access to the working end of the associated tool bit and said flexible member including a pair of flexible components extending upwardly from said base portion on either side of said base opening, each of said flexible components including an inwardly facing surface such that the inwardly facing surfaces of said pair of flexible components face one another, said inwardly facing surfaces engaging a resistance member held therebetween, said resistance member forming a selective resistance fit between said nest and the tool bit, said pair of flexible members designed to increase said resistance fit thereby producing said engaged position when said flexible members are pushed together.

26. A tool bit holder for releasably supporting a plurality of tool bits in a supported position, said tool bit holder comprising a plurality of nests in a spaced relationship to one another, each of said nests includes a bit opening that is radially spaced from a bit opening of an adjacently positioned nest, a plurality of said bit openings is deformable between a relaxed condition and a deformed condition and shaped to receive a single tool bit when in said relaxed condition, said bit opening designed to restrict axial movement of the tool bit when in said bit opening is in said deformed condition, a plurality of said nests including a flexible member movable relative to said bit opening between an engaged position and a disengaged position, said opening being in said deformed condition when said flexible member is in said engaged position, said opening being in said relaxed condition when said flexible member in said disengaged position, said flexible member designed to inhibit or prevent relative movement between said nest and the tool bit when said flexible member is in said engaged position, said flexible member designed to allow relative movement between said nest and the tool bit when said flexible member is in said disengaged position, at least one of said flexible members including an inwardly facing surface, said inwardly facing surface designed to move toward the elongated wall of the tool bit when the tool bit is position in said nest and when at least one of said flexible members is moved from said disengaged position to said engaged position, said movement of said inwardly facing surface toward the elongated wall of the tool bit is designed to increase frictional engagement of said nest with the elongated wall of the tool bit to thereby inhibit or prevent removal of the tool bit from said nest when said flexible member is moved to said engaged position.

27. The tool bit holder according to claim 26, wherein said bit opening is at least partially formed of a pliable grommet that is positioned in said nest, said grommet including an inwardly facing grommet surface defining at least a portion of said bit opening, said grommet surface being adjacent to the elongated side wall of the tool bit when the tool bit is in said supported position, said inwardly facing surface of said flexible member designed to deform said grommet surface when said flexible member is moved from said disengaged position to said engaged position such that said grommet surface frictionally engages the elongated surface of the tool bit thereby inhibiting or preventing said relative movement, said frictional engagement between said grommet and the tool bit when at least one of said flexible members is in said engaged position is greater than said frictional engagement when said at least one of said flexible members in said disengaged position.

28. The tool bit holder according to claim 26, wherein said flexible member includes two inwardly facing surfaces that are positioned about said bit opening.

29. The tool bit holder according to claim 27, wherein said flexible member includes two inwardly facing surfaces that are positioned about said bit opening.

30. The tool bit holder according to claim 26, wherein said base portion includes an opening coaxial with said nest to allow access to a working end of the tool bit, said opening has tapered edge.

31. The tool bit holder according to claim 30, wherein said opening includes a collar extending from said based and shaped to guidingly receive the tool into said nest.

32. The tool bit holder according to claim 26, wherein at least one of said flexible component includes a finger tab at a distal end.

33. The tool bit holder according to claim 32, wherein said finger tabs are positioned above said inwardly facing surfaces.

* * * * *